US005913355A

United States Patent [19]

Muramatsu

[11] Patent Number: 5,913,355

[45] **Date of Patent: *Jun. 22, 1999**

[54] CHILL VENT

[75] Inventor: Naokuni Muramatsu, Handa, Japan

[73] Assignee: NGK Insulators, Ltd., Japan

[ * ] Notice: This patent is subject to a terminal disclaimer.

[21] Appl. No.: 08/972,276

[22] Filed: Nov. 18, 1997

[30] Foreign Application Priority Data

Mar. 12, 1997 [JP] Japan ..... 9-057572

[51] Int. Cl.[6] ..... B22D 17/22

[52] U.S. Cl. ..... 164/305; 164/410; 249/135; 249/141; 425/812

[58] Field of Search ..... 164/305, 410; 425/420, 812; 249/135, 141

[56] References Cited

U.S. PATENT DOCUMENTS 3,006,043 10/1961 Goldhamer .

FOREIGN PATENT DOCUMENTS

| | | | |
|---|---|---|---|
| 1307458 | 2/1963 | France . | |
| 195 00 005 | 7/1996 | Germany . | |
| 60-6262 | 1/1985 | Japan | 164/305 |
| 61-38769 | 2/1986 | Japan . | |
| 4-157055 | 5/1992 | Japan | 164/305 |

OTHER PUBLICATIONS

Abstract of Japanese Patent Publication 7–116815 Published May 9, 1995.

*Primary Examiner*—J. Reed Batten, Jr.
*Attorney, Agent, or Firm*—Wall Marjama Bilinski & Burr

[57] ABSTRACT

A chill vent is provided with a cooling pipe around a zigzag-shaped gas exhaust passage, and made of a Be—Cu alloy which is superior in cooling power. An accelerated solidification of non-solidified molten metal entering into the chill vent is achieved, thereby effectively preventing flashing of the molten metal without complicating the construction or increasing the size of the entire facility.

4 Claims, 4 Drawing Sheets

CHILL VENT

BACKGROUND OF THE INVENTION

1. Field of the Invention

A permanent mold for die-casting light metals, such as aluminum alloy, zinc alloy, magnesium alloy and the like, is associated with a chill vent as means which functions when charging a molten metal into the mold cavity, for efficiently exhausting residual air and/or gas from inside to outside of the cavity, without spouting the molten metal or forming flashing.

The present invention relates to a chill vent used for die-casting such light metals and specifically aims to improve the cooling efficiency of non-solidified molten metal entering into the chill vent to thereby efficiently achieve an accelerated solidification.

2. Description of the Related Art

When air and/or gas is left in the cavity of the permanent mold at the time of die-casting, the air or gas tends to be dragged into the molten metal so as to cause gas holes and the like defects in the products and thereby degrade the product quality.

Therefore, as shown in FIG. 1, it is a conventional practice to provide a permanent mold with a chill vent 3 having a gas exhaust passage 2 which is communicated with the cavity 1 for pressure-casting a product, so that gas remaining in the cavity 1 can be discharged. In FIG. 1, reference numeral 4 designates a die casting permanent mold, and 5 a plunger for forcing out the molten metal.

In this instance, as shown in FIG. 1, the gas exhaust passage 2 is generally shaped in a zigzag-manner to ensure that, after the gas has been exhausted outside the chill vent, the molten metal is chilled in the passage 2 before it is flashed outside the permanent mold.

However, since the molten metal flows under a high-pressure condition, it is difficult to completely prevent the flashing of the molten metal even if the length of the passage 2 is increased by the zigzag shape.

In order to prevent flashing of molten metal with an improved reliability, it was considered necessary for the zigzag-shaped gas exhaust passage 2 to have a narrow gap d, or adopt a relatively steep angle θ of the zigzag-shape (waveform).

However, a narrow gap d causes the sectional area of the gas exhaust passage 2 to be decreased, while a steep angle θ causes the gas exhaust resistance to be increased. In any case, the gas exhaust efficiency is lowered and it becomes impossible to prevent formation of gas hole defects in the product.

Further, when the length L of the chill vent is increased, flashing of the molten metal can be prevented without narrowing the gap d of the zigzag-shaped gas exhaust passage 2 or adopting a steep angle θ of the zigzag-shape. However, such a measure results in increased size of the chill vent and difficulties for meeting with recent requirement for small-sized devices.

From such considerations, it has been customary to adopt a design wherein the gap d of the zigzag-shaped gas exhaust passage 2 ranges from 0.2 to 0.5 mm, the angle θ of the zigzag-shape ranges from 30 to 50°, and the length L of the chill vent ranges from 150 to 300 mm.

There have been proposed various types of chill vent which are capable of efficiently exhausting internal residual gas and preventing flashing of the molten metal, without increasing the size of the chill vent 3.

However, these proposals are still accompanied by problems that the structure becomes complicated and/or large-scaled auxiliary devices are required.

That is, in the former case, with reference to the basic structure such as that shown in FIG. 2, an elaborated arrangement is required such as a composite structure of telescopic elements 6 for the chill vent 3, which causes the entire chill vent 3 to be complicated in shape and/or structure.

Further, in the latter case, with reference to a representative arrangement such as that shown in FIG. 3, it is necessary to arrange a gas suction device 7 adjacent to the chill vent in order to further improve the gas exhaust efficiency. In this instance, although the size of the chill vent itself is not increased, the entire facility including the auxiliary devices is necessarily increased in size and troublesome and costly to manufacture.

DISCLOSURE OF THE INVENTION

The present invention has been accomplished in order to advantageously eliminate the above-mentioned problems. Thus, it is an object of the present invention to provide a chill vent which is capable of improving the cooling property of non-solidified molten metals entering into the chill vent, to thereby effectively prevent flashing of the molten metal without complicating the structure or increasing the size of the chill vent, with the size and shape maintained unchanged as before.

The present invention has been conceived as a result of findings and considerations which will be explained below.

First of all, the inventor conducted thorough studies and investigations seeking for the solution of the above-mentioned problems. As a result, it has been considered that an increased cooling efficiency of the non-solidified molten metal entering into the chill vent, that is, a forced cooling of the chill vent, enables the solidification to be effectively accelerated with the chill vent maintained compact. An experiment was thus conducted in which the chill vent was provided with cooling pipes adjacent to the zigzag-shaped gas exhaust passage, and cooling water was allowed to flow therethrough. As a result, it was found possible to achieve highly satisfactory results for attaining the intended object.

In this connection, there had been conventionally no concept of improving the solidifying effect from the viewpoint of the above-mentioned forced cooling, insofar as the casting chill vent is concerned. Such a concept was introduced by the present invention for the first time.

Moreover, the material of the chill vent has been conventionally comprised of a tool steel (for example, SKD61) which is the same as the cavity permanent mold. This is simply because it had been considered necessary for the chill vent to be as hard as the cavity permanent mold (usually, not less than about HB 400), in view of the above-mentioned high-pressure condition under which the molten metal is charged into the chill vent. In this way, the material of the chill vent itself has scarcely been examined up to present.

The inventor proceeded further investigations from such a viewpoint as well and reached a recognition that use of a copper alloy having a predetermined characteristic enables the intended object to be effectively attained, as is the case with what has been mentioned above.

The present invention is based on the above-mentioned recognition and findings.

According to a first aspect of the present invention, there is provided a chill vent comprising a zigzag-shaped gas exhaust passage which is communicated with a cavity of a die casting permanent mold at a parting surface thereof, wherein the chill vent has a cooling pipe adjacent to the zigzag-shaped gas exhaust passage.

According to a second aspect of the present invention, there is provided a chill vent comprising a zigzag-shaped gas exhaust passage which is communicated with a cavity of a die casting permanent mold at a parting surface thereof, wherein the chill vent consists essentially of a copper alloy which includes Be: 0.15 to 2.0 mass %, at least one composition selected from a group of Ni: 1.0 to 6.0 mass % and Co: 0.1 to 0.6 mass %, the balance being Cu and unavoidable impurities, and which is not less than HB 180 in Brinell hardness and not less than 0.2 cal/cm•s•°C. in thermal conductivity.

According to a third aspect of the present invention, there is provided a chill vent comprising a zigzag-shaped gas exhaust passage which is communicated with a cavity of a die casting permanent mold at a parting surface thereof, wherein the chill vent consists essentially of a copper alloy which includes Be: 0.15 to 2.0 mass %, at least one composition selected from a group of Ni: 1.0 to 6.0 mass % and Co: 0.1 to 0.6 mass %, the balance being Cu and unavoidable impurities, and which is not less than HB 180 in Brinell hardness and not less than 0.2 cal/cm•s•°C. in thermal conductivity, and wherein the chill vent has a cooling pipe adjacent to the zigzag-shaped gas exhaust passage.

In the above-mentioned second or third aspect of the present invention, the copper alloy as a material of the chill vent may further include at least one composition selected from a group of Al: 0.2 to 2.0 mass % and Mg: 0.2 to 0.7 mass %.

These aspects of the present invention will be described in further detail hereinafter.

A tool steel, such as SKD61 which has been conventionally used as a material of the chill vent, is low in thermal conductivity although high in hardness; therefore, a tool steel could not rapidly remove heat from the non-solidified molten metal and thereby chill the molten metal before flashing occurs.

However, as shown in FIG. 4 by way of example, by arranging the cooling pipes 6 in the chill vent so as to surround the zigzag-shaped gas exhaust passage 2 and perform a forced cooling of the passage, it was found possible effectively to prevent flashing of the molten metal without particular auxiliary facilities, even when the gap d of the passage 2, the angle θ of the zigzag-shape and the length L of the chill vent were maintained unchanged as before.

Although thermal conductivity of SKD61 is about 0.1 cal/cm•s•°C., an apparent thermal conductivity was increased to 0.2 cal/cm•s•°C. due to the above-mentioned forced cooling, and made it possible to achieve an effective solidifying effect, with the gap d of the passage 2 maintained unchanged as before.

Therefore, when installing the cooling pipes 6, care should be taken to adjust the piping manner and set the pipe diameter and the flow rate of a cooling medium in order for the surface of the gas exhaust passage 2 to have the thermal conductivity of not less than 0.2 cal/cm•s•°C.

Moreover, the cooling medium generally comprises water, though it is not limited thereto. Thus, there may be advantageously used other cooling medium such as ethylene glycol, oil, air or the like.

Also, the manner of arranging the cooling pipes 6 is not limited to that illustrated in FIG. 4, and other arrangement may be employed when the pipes are disposed adjacent to the gas exhaust passage 2 to surround the same.

According to the first aspect of the present invention, the provision of the cooling pipes 6 in the chill vent to surround the zigzag-shaped gas exhaust passage 2 and forcedly cool the passage 2 serves effectively to prevent flashing of the molten metal without lowering the gas exhausting efficiency.

Furthermore, in order to accelerate the chilling, it may be considered that the material of the chill vent itself is to be changed to a material which is more superior in thermal conductivity, for example, a copper alloy.

However, for example, known chromium-copper alloy is low in hardness (HB: about 120) and does not have a hardness which is sufficient to withstand the pressure of the molten metal.

On the other hand, among copper alloys having a high hardness is aluminum bronze (HB: as large as about 350); however, contrary to the basic requirement, this material has a thermal conductivity which is as low as a value equivalent to that of tool steel, so that it would be out of expectation to perform the chilling before flashing of the molten metal occurs.

Another problem is that copper alloys are difficult to use as a material for a permanent mold which is brought into a direct contact with the molten metal, because it is easily dissolved by light metal alloys as compared to a tool steel.

Therefore, the inventor initiated development of copper alloys which are not less than 180 in Brinell hardness HB and not less than 0.2 cal/cm•s•°C. in thermal conductivity, and which are not dissolved by light metal alloys.

The characteristic target values in designing the copper alloy as the material of the chill vent are defined for the grounds explained below.

That is to say, if the thermal conductivity is less than 0.2 cal/cm•s•°C., it is not substantially different from the thermal conductivity of SKD61 (0.2 cal/cm•s•°C.); an essentially conventional structure is unable to completely prevent flashing of the molten metal.

Also, if the hardness is less than 180 in Brinell hardness HB, the hardness is insufficient. Thus, when the molten metal collides with the zigzag-shaped gas exhaust passage 2 under a high-pressure condition, the surface of the passage 2 is unfavorably damaged to become rough, so that not only the service life is shortened, but also removal of product from the mold becomes difficult.

As a result, it has been found that the above-mentioned hardness and thermal conductivity can be obtained by a chill vent which is comprised of a copper alloy including Be: 0.15 to 2.0 mass %, at least one composition selected from the group of Ni: 1.0 to 6.0 mass % and Co: 0.1 to 0.6 mass %, and optionally one or two compositions selected from the group of Al: 0.2 to 2.0 mass % and Mg: 0.2 to 0.7 mass %, the balance being substantially Cu. Moreover, any one of Be, Ni, Co, Mg is a strongly oxidizing element and a copper alloy including these elements, when used as a material of the chill vent, causes a passive-state oxide film to be formed on the surface of the chill vent due to the strong oxidization property, thereby effectively preventing dissolution by light metal alloys.

The contents of Be, Ni, Co, Mg are limited to the above-mentioned ranges, respectively, for the grounds as follows.

Be: 0.15 to 2.0 Mass %

Be is useful to form a NiBe or CoBe compound by being bonded with Ni or Co, which effectively contributes to the improvement in strength, hence, hardness of the material, and also useful to form an oxide film. If Be is added by an amount less than 0.15 mass %, the effect of its addition is not significant. On the other hand, if the content of Be is more than 2.0 mass %, a further improvement in strength is not expected and the addition becomes disadvantageous in term of cost consideration. Therefore, it has been determined that Be is to be added in the range of 0.15 to 2.0 mass %.

Ni: 1.0 to 6.0 Mass %

Ni is useful to form a NiBe or $Ni_3Al$ compound by being bonded with Be or Al, which effectively contributes to the improvement in strength, hence, hardness of the material, and also useful to form an oxide film. If Ni is added by an amount less than 1.0 mass %, the effect of its addition is not significant. On the other hand, if the content of Ni is more than 6.0 mass %, the melting point of the alloy is increased and welding repair works become difficult. Therefore, it has been determined that Ni is to be added in the range of 1.0 to 6.0 mass %.

Co: 0.1 to 0.6 Mass %

Co is useful to form a CoBe compound by being bonded with Be, as is the case with Ni, which effectively contributes to the improvement in strength of the material. If Co is added by an amount less than 0.1 mass %, the effect of its addition is not significant. On the other hand, if the content of Co is more than 0.6 mass %, the manufacturing properties (hot workability) when manufacturing the copper alloy is degraded. Therefore, it has been determined that Co is to be added in the range of 0.1 to 0.6 mass %.

Al: 0.2 to 2.0 Mass %

Al is useful to form a $Ni_3Al$ compound by being bonded with Ni, which effectively contributes to the improvement in strength, and is also useful to form an oxide film and adjust the thermal conductivity. If Al is added by an amount less than 0.2 mass %, the effect of its addition is not significant. On the other hand, if the content of Al is more than 2.0 mass %, the thermal conductivity becomes too low. Therefore, it has been determined that Al is to be added in the range of 0.2 to 2.0 mass %.

Mg: 0.2 to 0.7 Mass %

Mg is useful to improve the hardness and form an oxide film. If Mg is added by an amount less than 0.2 mass %, the effect of its addition is not significant. On the other hand, if the content of Mg is more than 0.7 mass %, the manufacturing property (castability) when manufacturing the copper alloy is degraded. Therefore, it has been determined that Mg is to be added in the range of 0.2 to 0.7 mass %.

From the above considerations, according to the second aspect of the present invention, the copper alloy which is not less than 180 in Brinell hardness HB and not less than 0.2 cal/cm•s•°C. in thermal conductivity is prepared by adding to copper an appropriate amount of elements having a strong oxidization property, such as Be, Ni, Co, Al, Mg. By using the above copper alloy as a material of the chill vent, it is possible to obtain a die casting chill vent which is capable of effectively exhausting air and gasses outside the mold without being dissolved by light metal alloys, and of effectively chilling the non-solidified molten metal before flashing of the molten metal occurs.

Moreover, according to the third aspect of the present invention, by using the copper alloy having the above-mentioned characteristic as a material of the chill vent, and arranging the cooling pipes in the chill vent with the zigzag-shaped gas exhaust passage surrounded for forcedly cooling the passage, it is possible to improve the cooling power and shorten the length of the gas exhaust passage, thereby realizing a further small-sized chill vent.

BEST MODE FOR CARRYING OUT THE INVENTION

EMBODIMENT 1

Figure 1:
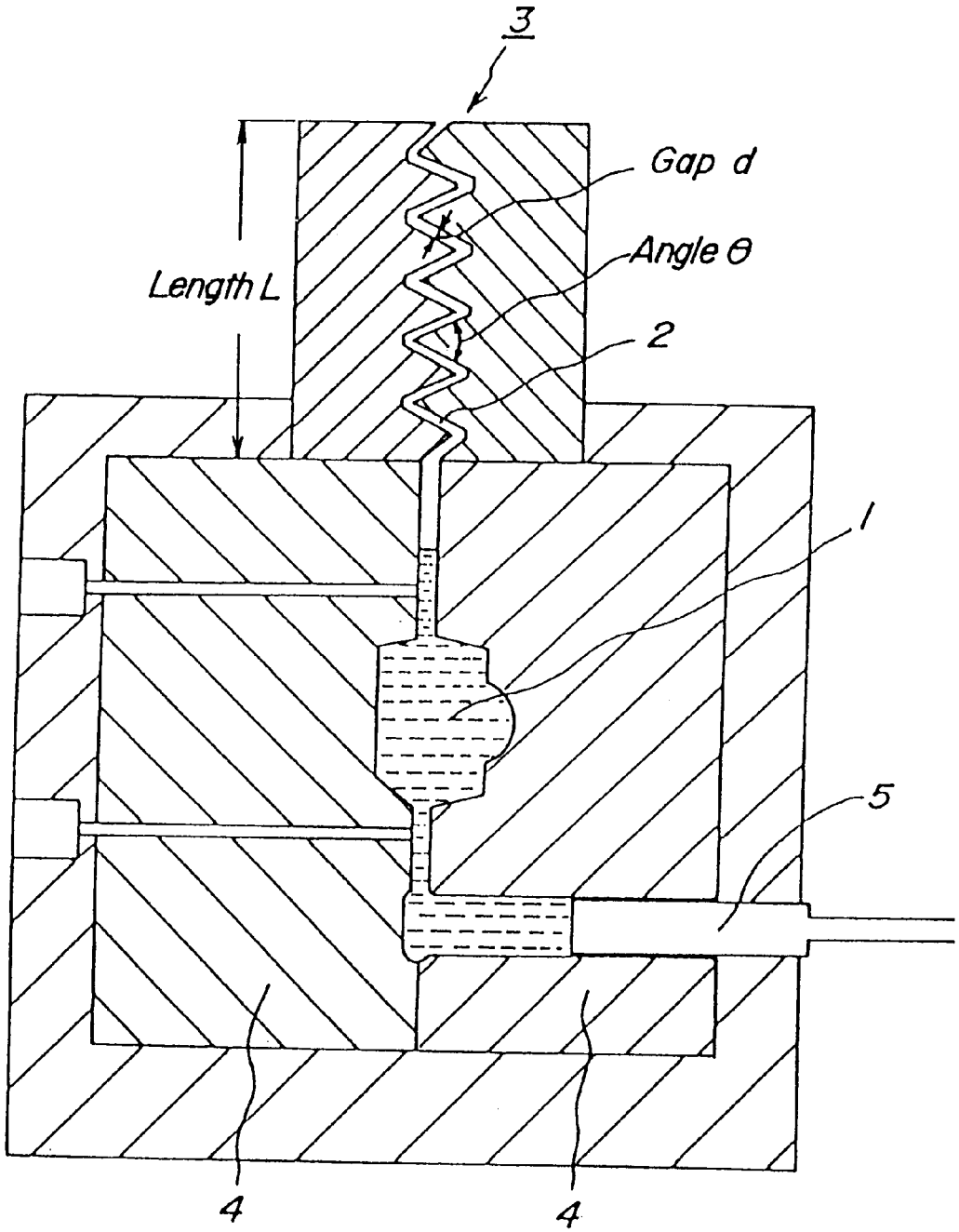
FIG. 1 Prior Art
FIG. 1 is a view showing the structure of a general chill vent together with a mold.
Figure 2:
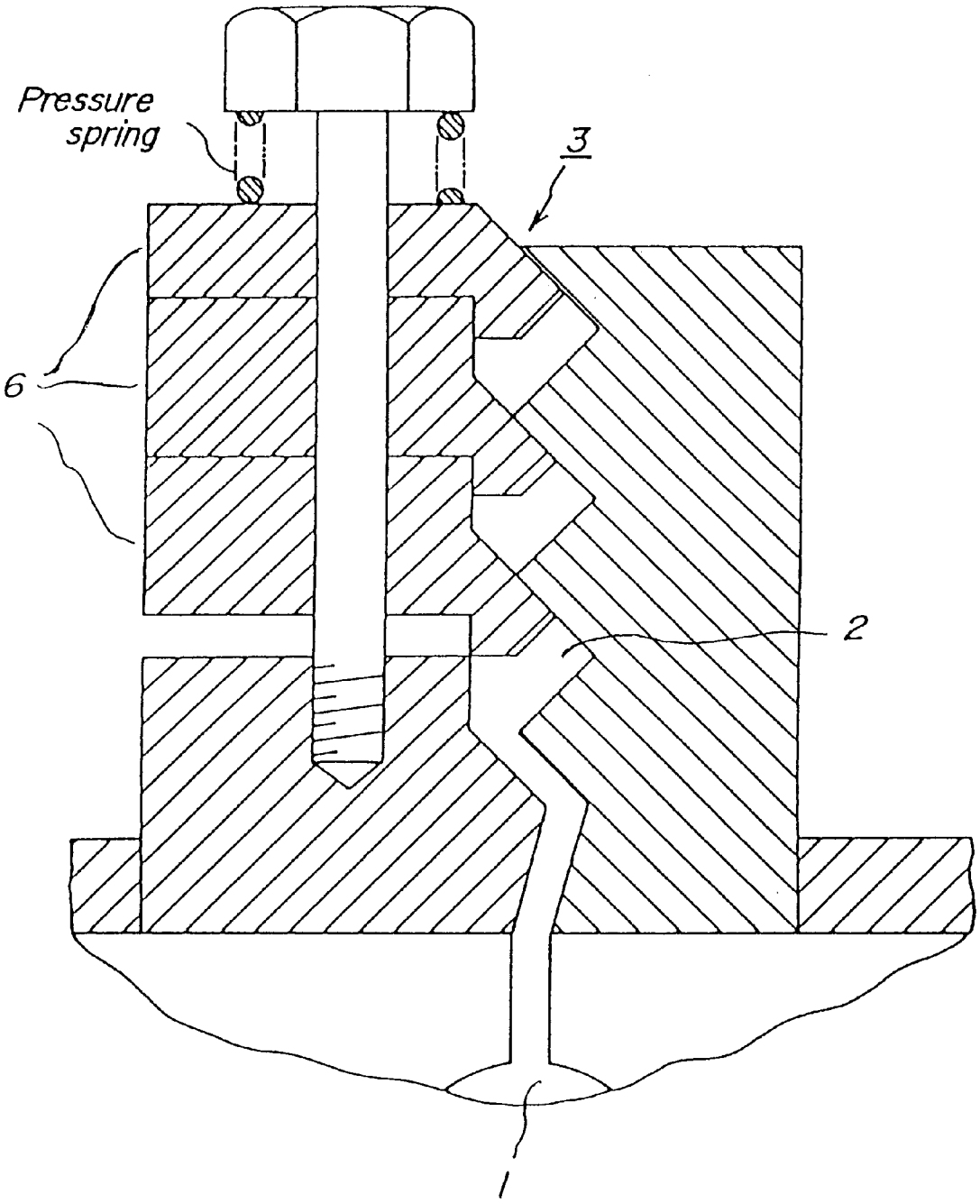
FIG. 2 Prior Art
FIG. 2 is a view showing the structure of a conventional chill vent with a complicated arrangement of divided telescopic elements.
Figure 3:
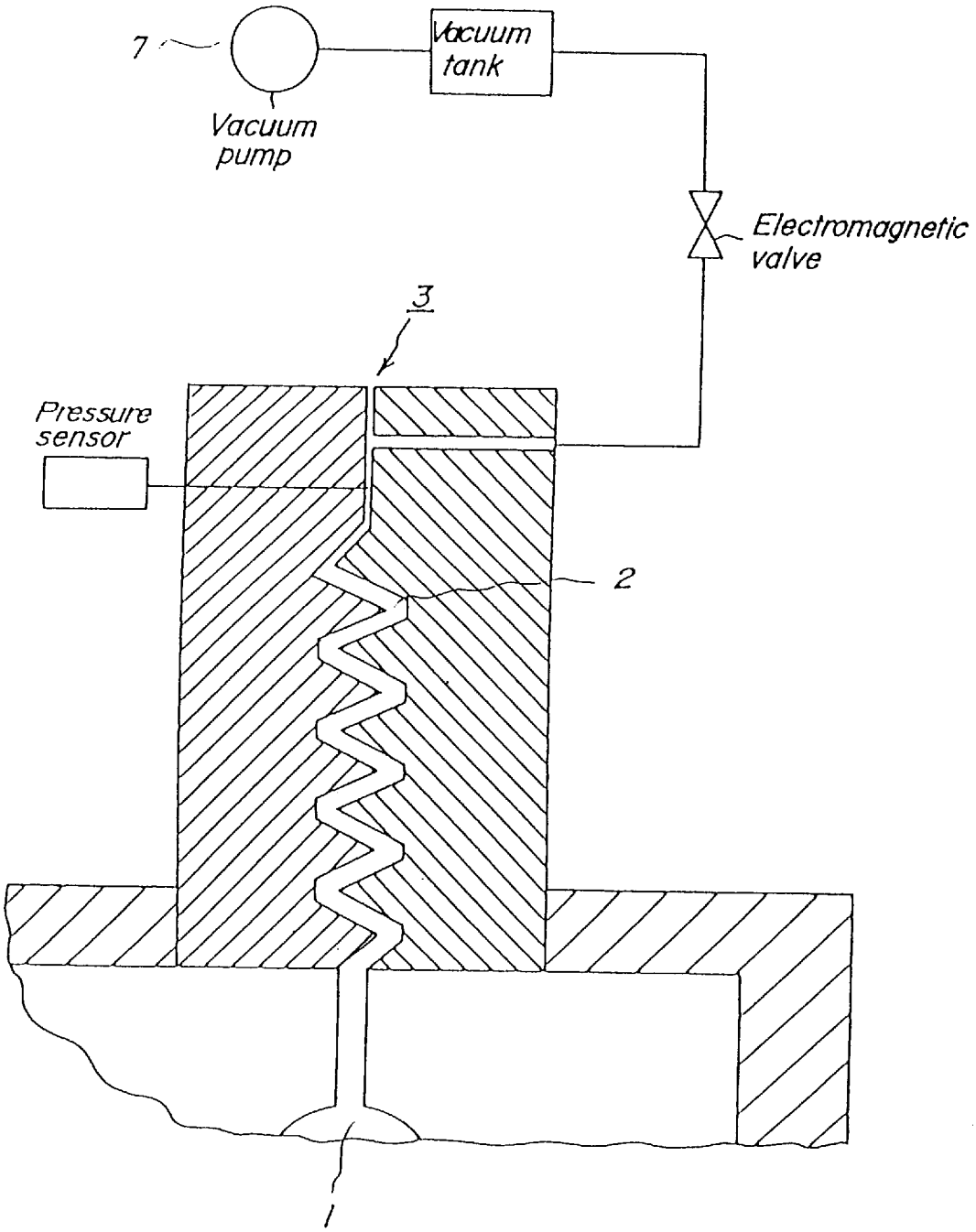
FIG 3 Prior Art
FIG. 3 is a view showing the structure of another conventional chill vent with a number of auxiliary devices.
Figure 4:
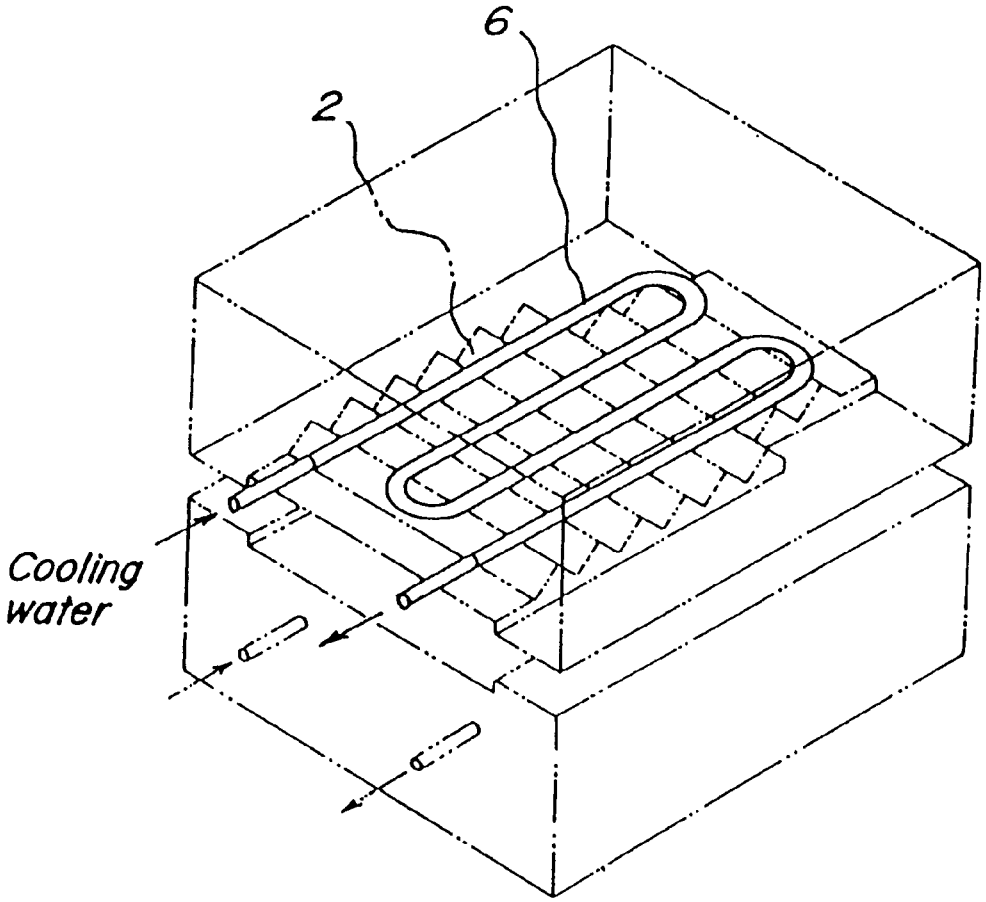
FIG. 4 is a view showing a construction of a chill vent according to the invention, which is provided with cooling pipes.

A molten metal of aluminum alloy (Al: 85 mass %, corresponding to ADC10 defined by JIS H 5302) was die-cast by using a chill vent (gap d of the gas exhaust passage: 0.6 mm, angle θ of the zigzag-shape: 50°, length L of the chill vent: 180 mm) made of SKD61 and provided with cooling pipes, as shown in FIG. 4. On this occasion, the flow rate of the cooling water was set to 4 l/min.

For comparison, the chill vent was also subjected to an experiment corresponding to a conventional example in which the cooling water is not admitted.

As a result, in the case of the experiment for the conventional example, the molten metal was flashed, whereas, in the case of die casting with a forced cooling according to the first aspect of the present invention, the molten metal was not flashed.

EMBODIMENT 2

The chill vent identical in size and construction with Embodiment 1 was prepared by using various materials listed in Table 1. Die-casting was carried out as in the case of Embodiment 1, while stopping the supply of the cooling water to the cooling pipes.

The results of the examination in respect of the flashing condition, the condition of the pin hole defects on the products, and the surface roughness of the gas exhaust passage are shown in Table 1.

As can be appreciated from Table 1, according to the second aspect of the present invention, copper alloys satisfying the predetermined composition and having the predetermined characteristics were used so that there were caused no flashing of the molten metal during casting, or pin hole defects in the products, and there was found only a slight surface roughness of the gas exhaust passage.

TABLE 1

| | Composition | Thermal conductivity (cal/cm · s · ° C.) | Hardness (HB) | Flashing | Pin holes | Surface roughness | Remarks |
|---|---|---|---|---|---|---|---|
| 1 | Cu—0.05Be—1.0Ni | 0.6 | 150 | ○ | ○ | X | Comparative example |
| 2 | Cu—0.20Be—1.5Ni | 0.5 | 195 | ○ | ○ | ○ | Inventive example |
| 3 | Cu—0.25Be—1.5Ni—0.50Co | 0.49 | 207 | ○ | ○ | ○ | Inventive example |
| 4 | Cu—0.25Be—1.5Ni—0.50Co—0.49Mg | 0.48 | 212 | ○ | ○ | ○ | Inventive example |
| 5 | Cu—0.45Be—2.0Ni | 0.48 | 210 | ○ | ○ | ○ | Inventive example |
| 6 | Cu—0.05Be—1.5Ni—1.5Al | 0.45 | 163 | ○ | ○ | X | Comparative example |
| 7 | Cu—0.20Be—1.5Ni—1.5Al | 0.45 | 197 | ○ | ○ | ○ | Inventive example |
| 8 | Cu—0.55Be—4.5Ni—1.5Al | 0.29 | 235 | ○ | ○ | ○ | Inventive example |
| 9 | Cu—0.55Be—4.5Ni—0.40Co—1.5Al | 0.29 | 241 | ○ | ○ | ○ | Inventive example |
| 10 | Cu—1.7Be—0.20Co | 0.25 | 311 | ○ | ○ | ○ | Inventive example |
| 11 | Cu—1.85Be—0.25Co | 0.2 | 355 | ○ | ○ | ○ | Inventive example |
| 12 | SKD61 | 0.1 | 415 | X | * | ○ | Comparative example |
| 13 | Cu—0.13Cr(Chromium copper) | 0.77 | 120 | ○ | ○ | X | Comparative example |
| 14 | Aluminum bronze (JIS C 6191) | 0.14 | 185 | X | * | ○ | Comparative example |

Evaluation:
Flashing ○: Not appeared X: Appeared
Pin holes ○: Not appeared X: Appeared
*Not evaluated because of the flashing appearing
Surface roughness of the gas purging passage (After 100 shots)
○: Not appeared on the polished surface
X: Appeared on the polished surface

EMBODIMENT 3

Chill vents made of materials of Nos. 4 and 9 shown in Table 1 were used for performing die-casting as in the case of Embodiment 2, while being forcedly cooled by admitting cooling water at a flow rate of 4 l/min.

As a result, for any of the products, the molten metal could be prevented from entering into the gas exhaust passage over ½ of the total length (90 mm/180 mm) thereof. Consequently, according to the third aspect of the present invention, the length L of the chill vent can be shortened by a length of the gas exhaust passage over which the molten metal can be prevented from entering, i.e. ½ of the total length.

INDUSTRIAL SUSCEPTIBILITY

As described above, according to the first and second aspects of the present invention, the gas remaining in the cavity can be smoothly exhausted outside the mold and flashing of the molten metal can be effectively prevented without complicating the construction of the chill vent and increasing the size, in comparison to the prior art.

Moreover, according to the third aspect of the present invention, in addition to the above-mentioned effects, it is also possible to realize a further small-sized chill vent.

What is claimed is:

1. A chill vent comprising a zigzag-shaped gas exhaust passage in communication with a cavity of a die casting permanent mold at a parting surface thereof, said chill vent being made of a copper alloy comprising 0.15 to 2.0 mass % Be, at least one element selected from the group consisting 1.0 to 6.0 mass % Ni and 0.1 to 0.6 mass % Co, and the balance being Cu and unavoidable impurities, said alloy having a Brinell hardness of not less than HB180 and a thermal conductivity of not less than 0.2 cal/cm•s•°C.

2. The chill vent of claim 1, wherein said copper alloy further comprises at least one element selected from the group consisting of 0.2 to 2.0 mass % Al and 0.2 to 0.7 mass % Mg.

3. A chill vent comprising a zigzag-shaped gas exhaust passage in communication with a cavity of a die casting permanent mold at a parting surface thereof, said chill vent being made of a copper alloy comprising 0.15 to 2.0 mass % Be, at least one element selected from the group consisting of 1.0 to 6.0 mass % Ni and 0.1 to 0.6 mass % Co, and the balance being Cu and unavoidable impurities, said alloy having a Brinell hardness of not less than HB180 and a thermal conductivity of not less than 0.2 cal/cm•s•°C., and wherein said chill vent has a cooling pipe adjacent to said zigzag-shaped gas exhaust passage.

4. The chill vent of claim 3, wherein said copper alloy further comprises at least one element selected from the group consisting of 0.2 to 2.0 mass % Al and 0.2 to 0.7 mass % Mg.

* * * * *